US007025595B1

(12) United States Patent
Chan et al.

(10) Patent No.: US 7,025,595 B1
(45) Date of Patent: Apr. 11, 2006

(54) ELECTRONIC DEVICE WITH ADJUSTABLE HOUSINGS

(75) Inventors: Ho-Min Chan, Chang-Hua Hsien (TW); Shiau-Wei Su, Taichung (TW)

(73) Assignee: Universal Scientific Industrial Co., Ltd., Nan-Tou Hsien (TW)

( * ) Notice: Subject to any disclaimer, the term of this patent is extended or adjusted under 35 U.S.C. 154(b) by 0 days.

(21) Appl. No.: 11/104,412

(22) Filed: Apr. 13, 2005

(51) Int. Cl.
*H01R 39/00* (2006.01)
*H01R 41/00* (2006.01)

(52) U.S. Cl. ..... 439/6; 439/954

(58) Field of Classification Search ..... 439/8, 439/6, 13, 11, 31, 1, 162–165, 954
See application file for complete search history.

(56) References Cited

U.S. PATENT DOCUMENTS 3,459,873 A * 8/1969 Harris et al. ..... 439/8
4,533,796 A * 8/1985 Engelmore ..... 439/13
6,786,743 B1 * 9/2004 Huang ..... 439/6
6,893,267 B1 * 5/2005 Yueh ..... 439/8

* cited by examiner

*Primary Examiner*—Tho D. Ta
*Assistant Examiner*—Felix O. Figueroa
(74) *Attorney, Agent, or Firm*—Nixon & Vanderhye P.C.

(57) ABSTRACT

An electronic device includes a main housing that has a dome-shaped portion formed with an arcuate slot unit, a support body that is disposed in the main housing and that has a dome-shaped portion formed with an arcuate slot unit, an arcuate sliding piece that is disposed movably between the dome-shaped portions of the main housing and the support body and that is in sliding engagement with the dome-shaped portion of the support body, a connector housing that has a shaft portion extending through the arcuate slot unit in the dome-shaped portion of the main housing and that is coupled to the arcuate sliding piece, an electronic component that is mounted in the main housing, and an electrical connector that is mounted in the connector housing and that is coupled to the electronic component.

13 Claims, 10 Drawing Sheets

ELECTRONIC DEVICE WITH ADJUSTABLE HOUSINGS

BACKGROUND OF THE INVENTION

1. Field of the Invention

The invention relates to an electronic device, more particularly to an electronic device that includes adjustable housings.

2. Description of the Related Art

Referring to FIGS. 1 and 2, a conventional electronic device 9 includes a main housing 92, a connector housing 93, a pivot joint 94, an antenna 91, and an electrical connector 95. The pivot joint 94 interconnects and permits relative rotation between the main housing 92 and the connector housing 93. The antenna 91 is mounted in the main housing 92. The electrical connector 95 is mounted in the connector housing 93 and is coupled to the antenna 91.

In use, when the electrical connector 95 is connected to a system unit 80 of a computing device, the main housing 92 may be adjusted to different angles with respect to the connector housing 93 to orient the antenna 91 to a desired direction. Although the conventional electronic device 9 achieves its intended purpose, adjustment of the main housing 92 is limited between 0- to 180-degree angle with respect to the connector housing 93. Within this range, the antenna 91 may not be able to properly transmit or receive signals.

SUMMARY OF THE INVENTION

Therefore, the object of the present invention is to provide an electronic device that is capable of overcoming the aforesaid drawback of the prior art.

According to the present invention, an electronic device comprises a main housing, a support body, an arcuate sliding piece, a connector housing, an electronic component, and an electrical connector. The main housing has a dome-shaped portion that is formed with an arcuate slot unit. The support body is disposed in the main housing, and has a dome-shaped portion that is formed with an arcuate slot unit. The arcuate sliding piece is disposed movably between the dome-shaped portion of the main housing and the dome-shaped portion of the support body, and is in sliding engagement with the dome-shaped portion of the support body. The connector housing has a shaft portion that extends through the arcuate slot unit in the dome-shaped portion of the main housing and that is coupled to the arcuate sliding piece. The electronic component is mounted in the main housing. The electrical connector is mounted in the connector housing, and is coupled to the electronic component.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
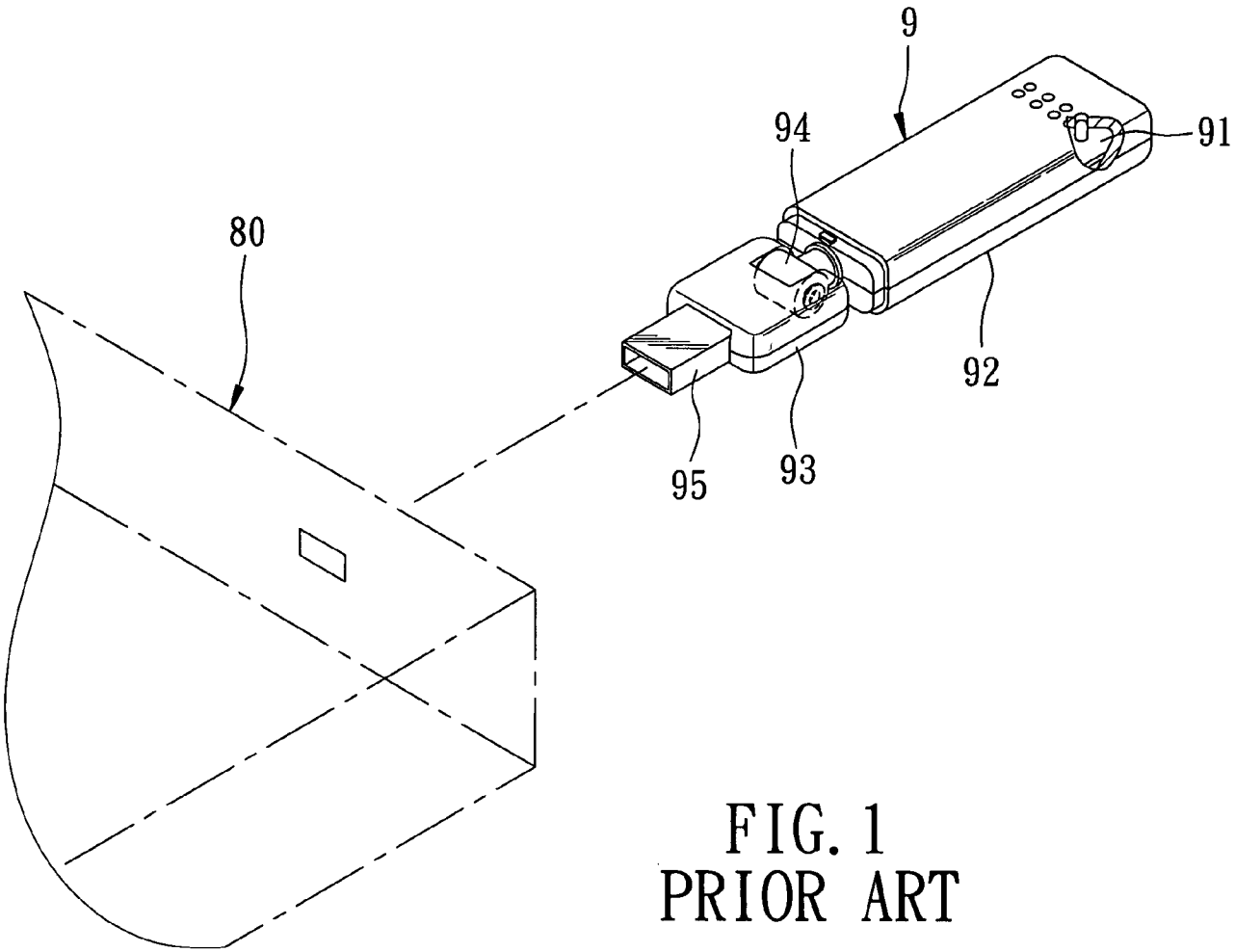
FIG. 1 PRIOR ART
FIG. 1 is a perspective view of a conventional electronic device.
Figure 2:
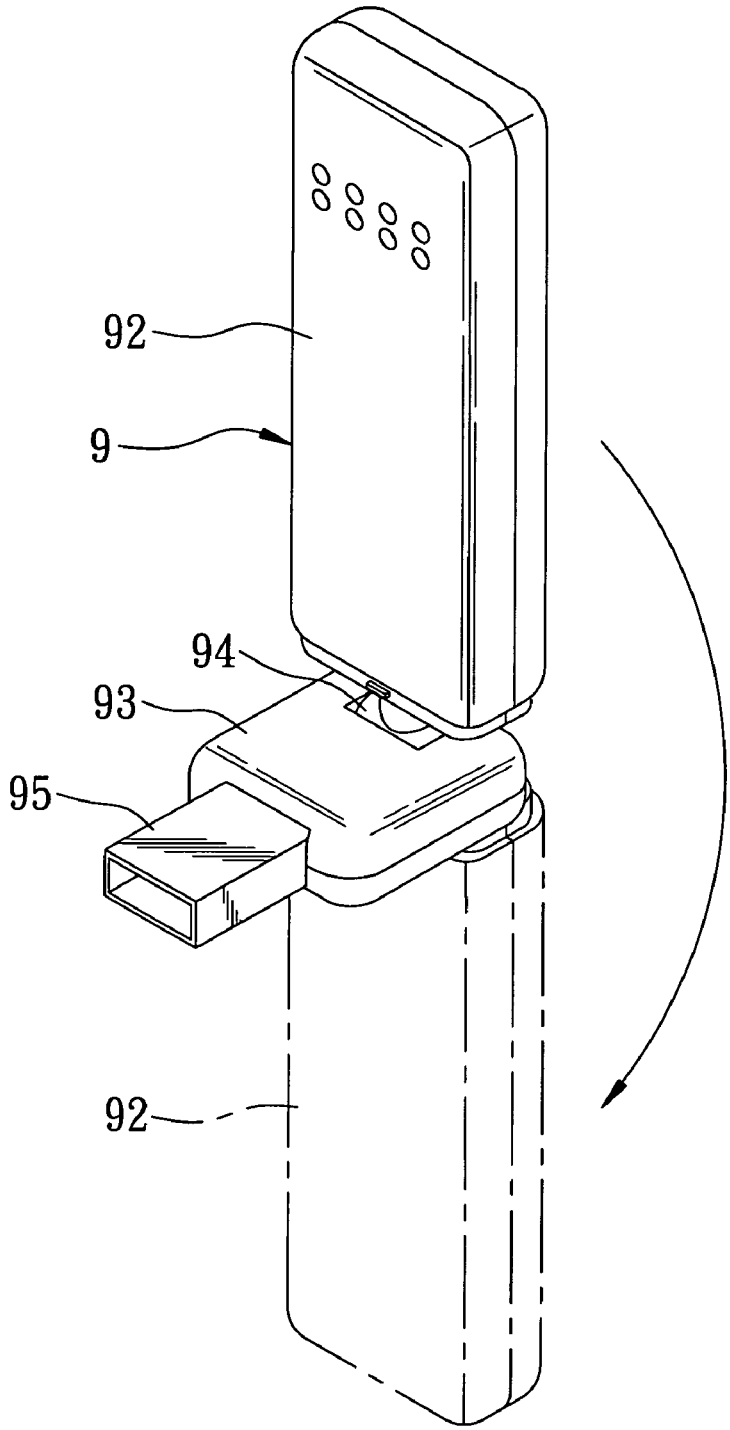
FIG. 2 PRIOR ART
FIG. 2 is perspective view of the conventional electronic device in a state of use.

Before the present invention is described in greater detail, it should be noted that like elements are denoted by the same reference numerals throughout the disclosure.

Figure 3:
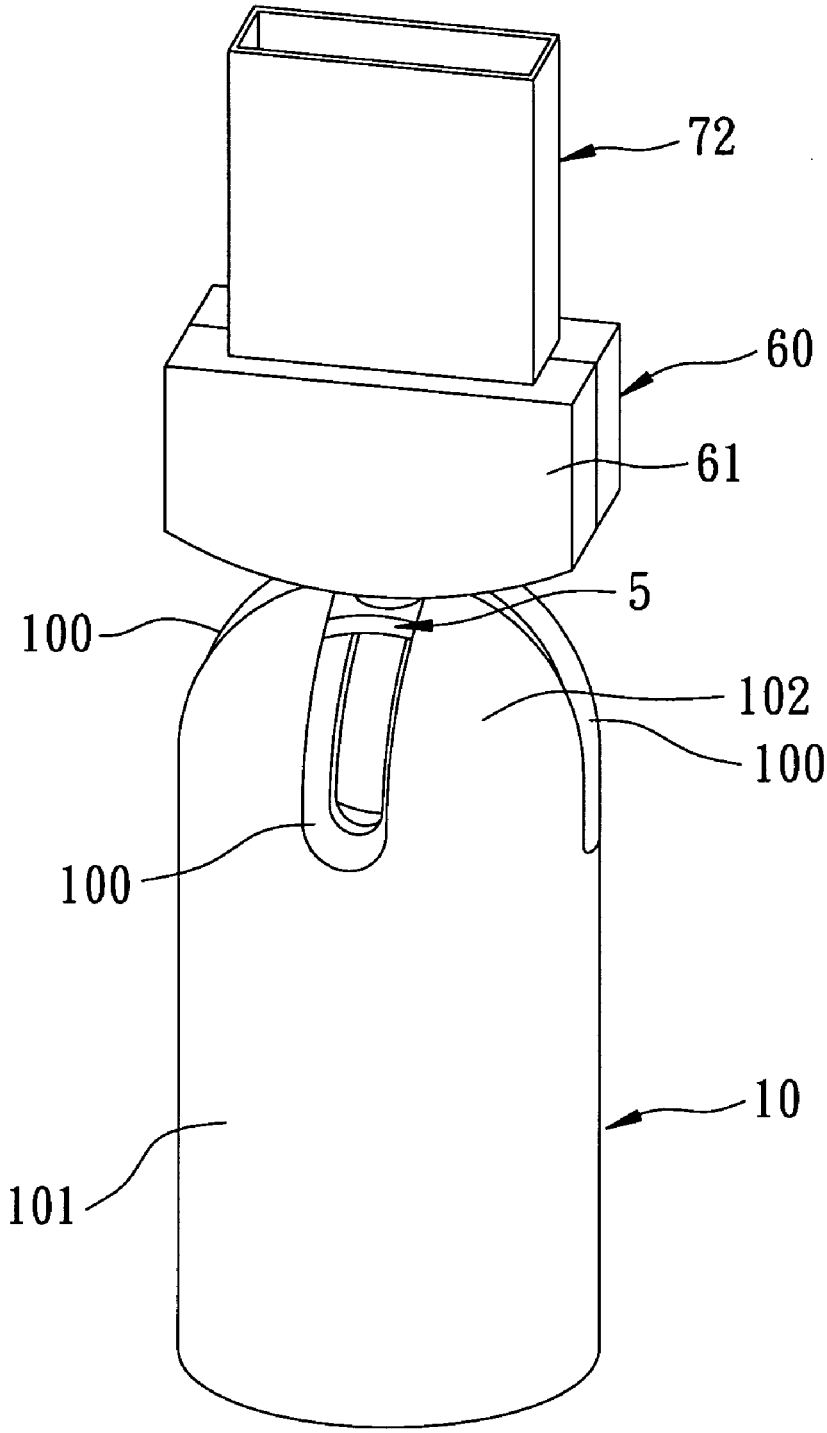
FIG. 3 is a perspective view of the first preferred embodiment of an electronic device according to the present invention.
Figure 4:
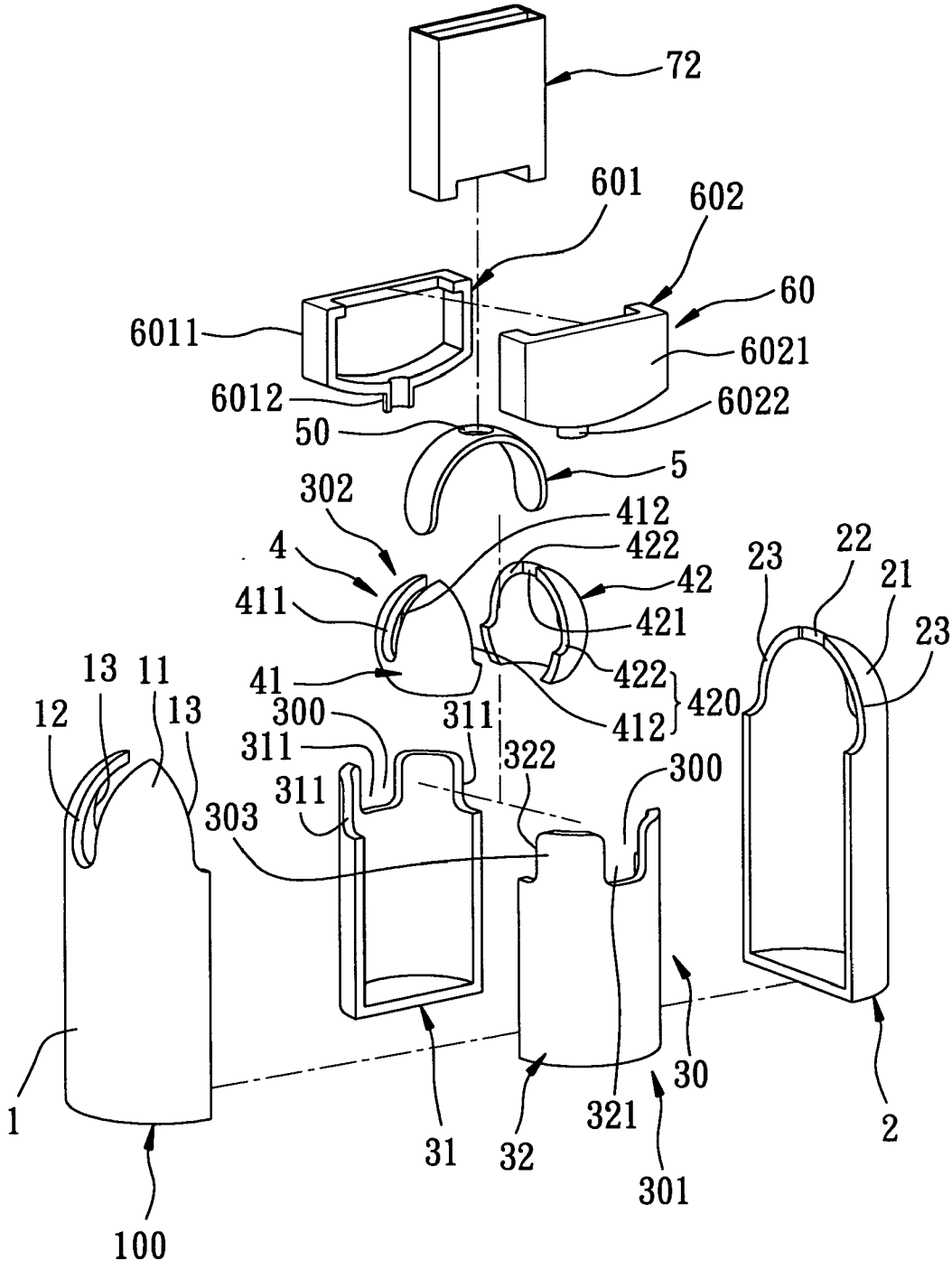
FIG. 4 is an exploded perspective view of the first preferred embodiment.
Figure 5:
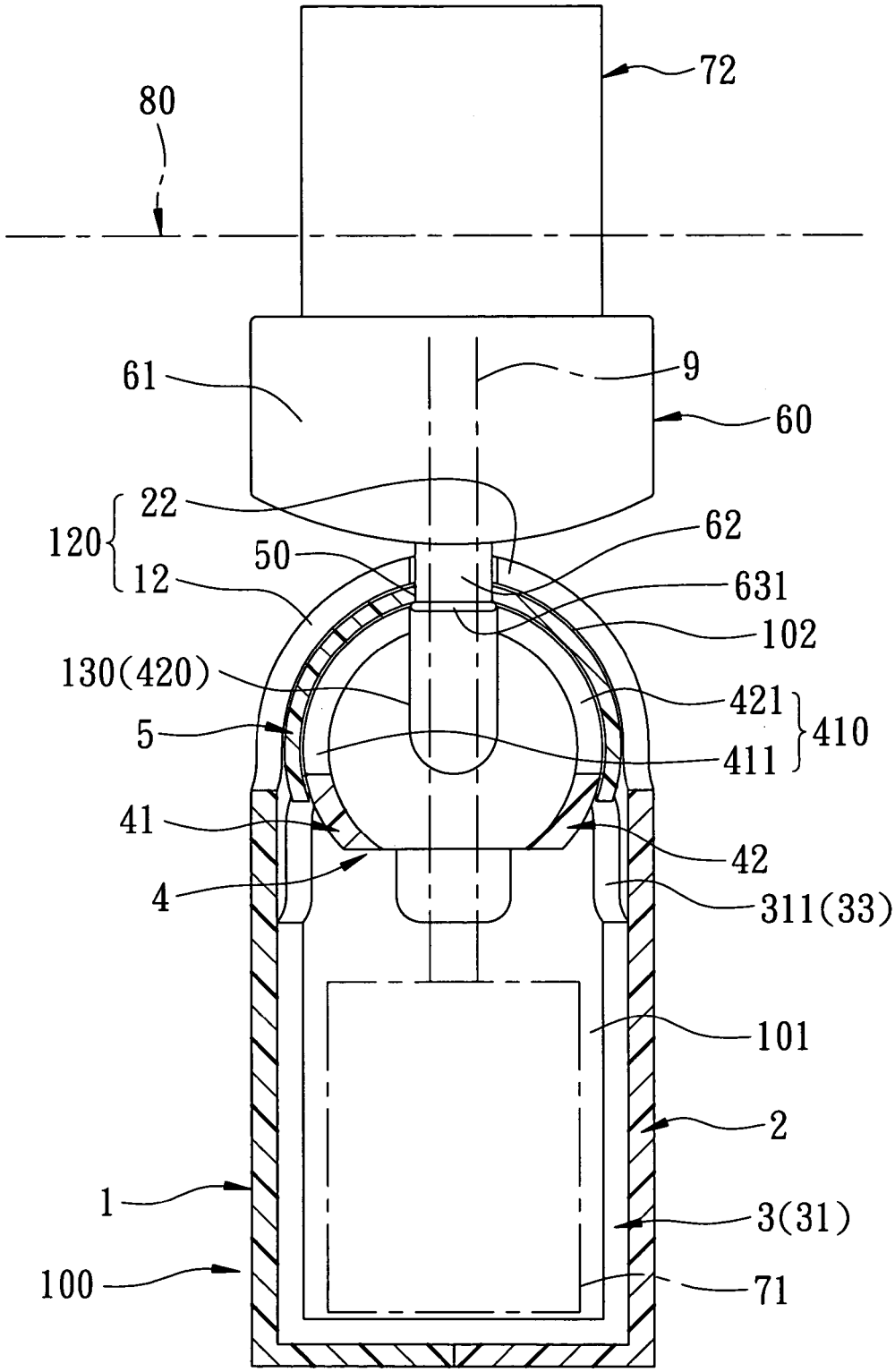
FIG. 5 is a partly sectional view of the first preferred embodiment.

Referring to FIGS. 3 to 5, the first preferred embodiment of an electronic device according to this invention is shown to include a main housing 10, a support body 30, an arcuate sliding piece 5, a connector housing 60, an electronic component 71, and an electrical connector 72.

The main housing 10 has a cylindrical-shaped portion 101, and a dome-shaped portion 102 that is opposite to the cylindrical-shaped portion 101 of the main housing 10 and that is formed with a pair of crossed arcuate slots 100. In this embodiment, the main housing 10 includes complementary first and second parts 1, 2, each of which has a curved portion 11, 21 that is formed with a groove 12, 22 and a pair of recesses 13, 23 separated by the groove 12, 22. The dome-shaped portion 102 of the main housing 10 is defined by the confronting pair of the curved portions 11, 21 of the first and second parts 1, 2 of the main housing 10. The crossed arcuate slots 100 in the dome-shaped portion 102 of the main housing 10 are defined by the confronting pair of the grooves 12, 22 and the confronting two pairs of the recesses 13, 23 in the curved portions 11, 21 of the first and second parts 1, 2 of the main housing 10. In this embodiment, the main housing 10 is made from plastic.

The support body 30 has a cylindrical-shaped portion 301 and a dome-shaped portion 302. The cylindrical-shaped portion 301 of the support body 30 conforms to the shape of the cylindrical-shaped portion 101 of the main housing 10, and has an open end 303. The open end 303 of the cylindrical-shaped portion 301 of the support body 30 is formed with a plurality of notches 300, each of which is angularly displaced from an adjacent one of the notches 300. The cylindrical-shaped portion 301 of the support body 30 includes complementary first and second parts 31, 32, each of which has an end portion formed with a groove 311, 321 and a pair of recesses 312, 322. The open end 303 of the cylindrical-shaped portion 301 of the support body 30 is defined by the confronting pair of the end portions of the first and second parts 31, 32 of the cylindrical-shaped portion 301 of the support body 30. Two of the notches 300 in the cylindrical-shaped portion 301 of the support body 30 are defined by the confronting two pairs of the recesses 312, 322 in the first and second parts 31, 32 of the cylindrical-shaped portion 301 of the support body 30. The other two of the notches 300 in the cylindrical-shaped portion 301 of the support body 30 are defined by the grooves 311, 321 in the first and second parts 31, 32 of the cylindrical-shaped portion 301 of the support body 30. The dome-shaped portion 302 of the support body 30 conforms to the shape of the dome-shaped portion 102 of the main housing 10, is formed with a pair of crossed arcuate slots, is disposed on the open end 303 of the cylindrical-shaped portion 101 of the main housing 10, and includes complementary first and seconds parts 41, 42, each of which is formed with a groove 411, 421 and a pair of recesses 412, 422 divided by the groove 411, 421. The crossed arcuate slots in the dome-shaped portion 302 of the support body 30 are defined by the confronting pair of the grooves 411, 421 and the confronting two pairs of the recesses 412, 422 in the first and second parts 41, 42 of the dome-shaped portion 302 of the support body 30. In this embodiment, the support body 30 is made from plastic.

It is noted that the main housing 10 houses the support body 30 such that the crossed arcuate slots in the dome-shaped portion 302 of the support body 30 are respectively aligned with the crossed arcuate slots 100 in the dome-shaped portion 102 of the main housing 10, and such that a clearance exists between the dome-shaped portion 302 of the support body 30 and the dome-shaped portion 102 of the main housing 10.

The arcuate sliding piece 5 is disposed movably in the clearance between the dome-shaped portion 102 of the main housing 10 and the dome-shaped portion 302 of the support body 30, conforms to the shape of the dome-shaped portion 102 of the main housing 10 and the dome-shaped portion 302 of the support body 30, is in sliding engagement with the dome-shaped portion 302 of the support body 30, and is formed with a hole 50 therethrough. In this embodiment, the arcuate sliding piece 5 is made from plastic.

The connector housing 60 has a connector-mounting portion 61 and a shaft portion 62. The shaft portion 62 of the connector housing 60 extends through the crossed arcuate slots 100 in the dome-shaped portion 102 of the main housing 10, and is coupled rotatably to the arcuate sliding piece 5. The connector housing 60 includes complementary first and second parts 601, 602, each of which has first and second end portions 6011, 6012, 6021, 6022. The connector-mounting portion 61 of the connector housing 60 is defined by the confronting pair of the first end portions 6011, 6021 of the first and second parts 601, 602 of the connector housing 60. The shaft portion 62 of the connector housing 60 is defined by the confronting pair of the second end portions 6012, 6022 of the first and second parts 601, 602 of the connector housing 60. It is noted that the connector-mounting portion 61 and the shaft portion 62 of the connector housing 60 are formed integrally into a single piece. In this embodiment, the connector housing 60 is made from plastic.

The electronic component 71 is mounted in the cylindrical-shaped portion 301 of the support body 30. In this embodiment, the electronic component 71 is an antenna.

The electrical connector 72 is mounted in the connector-mounting portion 61 of the connector housing 60. In this embodiment, the electrical connector 72 is a universal serial bus (USB) connector.

The electronic device further includes a cable 9 that connects electrically the electrical connector 72 to the electronic component 71.

The first and second parts 31, 32 of the cylindrical-shaped portion 301 of the support body 30 are first matched during assembly. Then, the first and second parts 41, 42 of the dome-shaped portion 302 of the support body 30 are matched and are placed on the open end 303 of the cylindrical-shaped portion 301 of the support body 30. Thereafter, the first and second parts 601, 602 of the connector housing 60 are matched such that the electrical connector 72 is sandwiched therebetween. Subsequently, the shaft portion 62 of the connector housing 60 is inserted through the crossed arcuate slots 100 in the dome-shaped portion 102 of the main housing 10 and the hole 50 in the arcuate sliding piece 5, and is flattened at an end thereof, such as by hot pressing, so as to secure the connector housing 60 to the arcuate sliding piece 5. Finally, the first and second parts 1, 2 of the main housing 10 are matched such that the support body 30 is enclosed therein. It is noted that the cable 9 and the electronic component 71 have been assembled beforehand.

Figure 6:
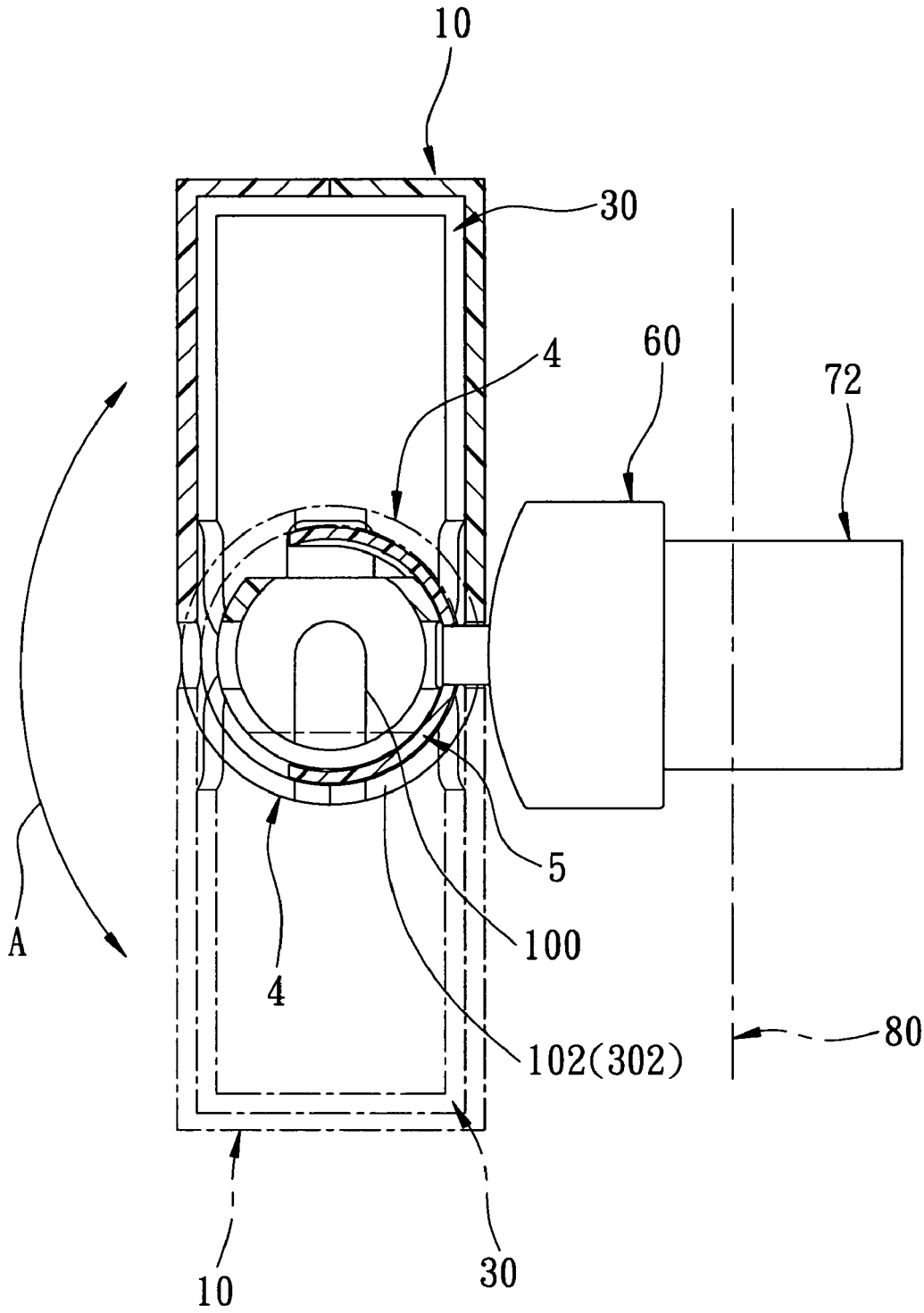
FIG. 6 is a partly sectional view to illustrate a state where a main housing is adjusted with respect to a connector housing of the first preferred embodiment.
Figure 7:
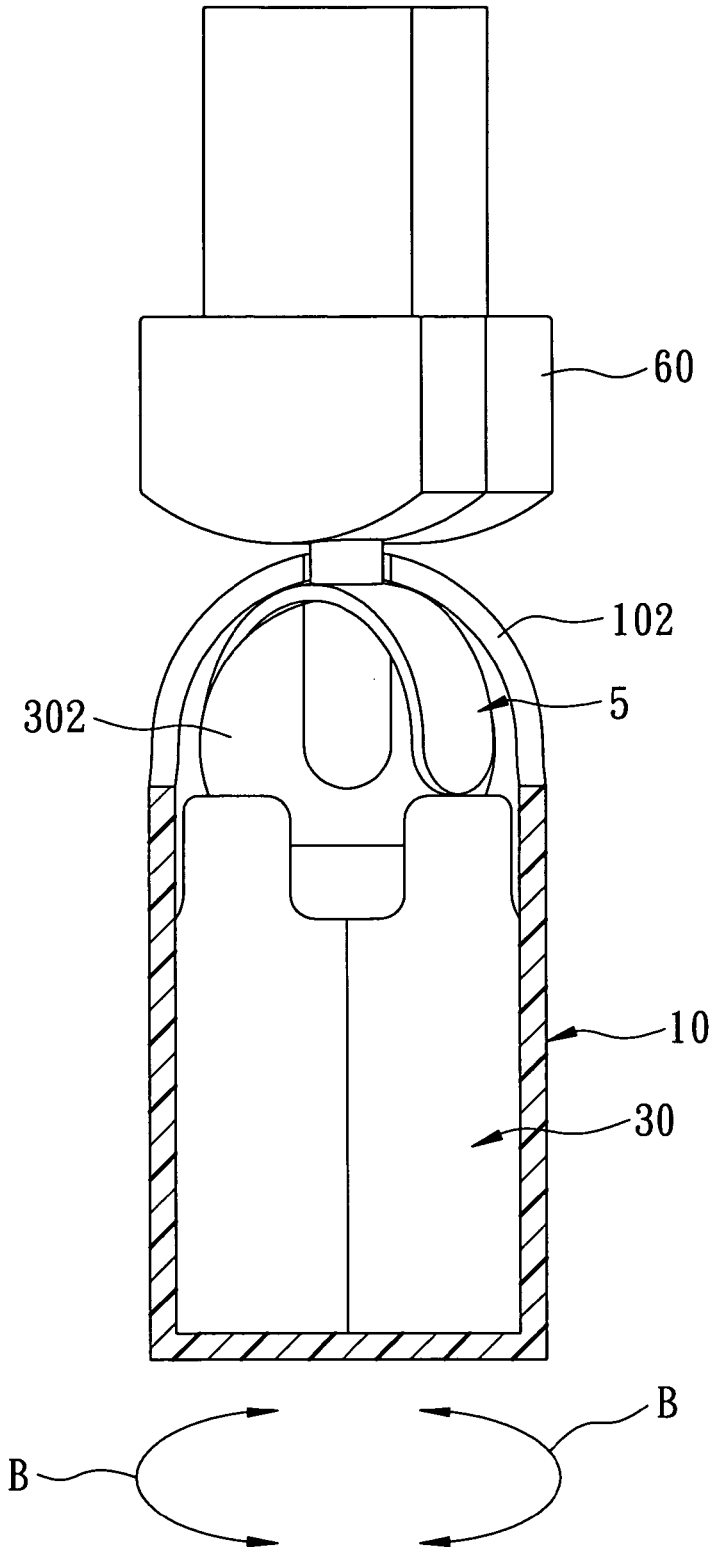
FIG. 7 is a fragmentary sectional view to illustrate a state where the main housing is rotated with respect to the connector housing of the first preferred embodiment.

In use, referring to FIG. 6, when the electrical connector 71 is connected to a system unit 80 of a computing device, the main housing 10 may be adjusted to different angles with respect to the connector housing 60 to orient the electronic component 71 to a desired direction. The crossed arcuate slots 100 in dome-shaped portion 102 of the main housing 10 and the crossed arcuate slots in the dome-shaped portion 302 of the support body 30 permit adjustment of the main housing 10 between 0- and 180-degree, as indicated by arrow (A), with respect to the connector housing 60 in two directions, which are transverse to each other. Furthermore, referring to FIG. 7, since the arcuate sliding piece 5 conforms to the shapes of the dome-shaped portion 102 of the main housing 10 and the dome-shaped portion 302 of the support body 30, the main housing 10 may be rotated between 0- and 360-degree angle, as indicated by arrows (B), with respect to the connector housing 60. The construction as such permits orientation of the electronic component 71 (see FIG. 5) to properly transmit or receive signals.

It is noted that when rotating the main housing 10 relative to the connector housing 60, it is advisable to rotate the main housing 10 in alternating opposite directions, instead of continuously in the same directions, to prevent damaging the cable 9.

It is also noted that the frictional contact between the dome-shaped portion 302 of the support body 30 and the arcuate sliding piece 5 retains the main housing 10 at a desired angle with respect to the connector housing 60.

Figure 8:
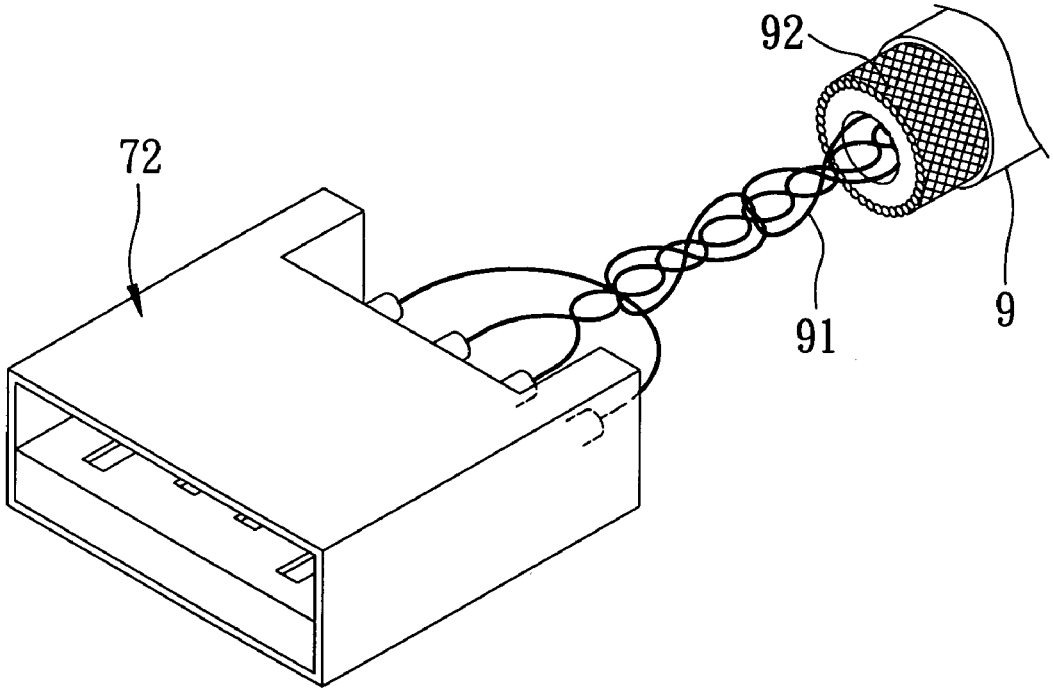
FIG. 8 is a fragmentary perspective view to illustrate a cable of the first preferred embodiment.

It is further noted that, referring to FIG. 8, the cable 9 includes two pairs of twisted wires 91, and a meshed metallic shield 92 that surrounds the twisted wires 91 and that is connected to an electrical ground (not shown) to thereby prevent electromagnetic interference.

In an alternative embodiment, the arcuate sliding piece 5 and the dome-shaped portion 302 of the support body 30 are made from ferrites. The construction as such protects the cable 9 from external magnetic interferences, thereby enhancing transmission and reception quality of the electronic component 71.

Figure 9:
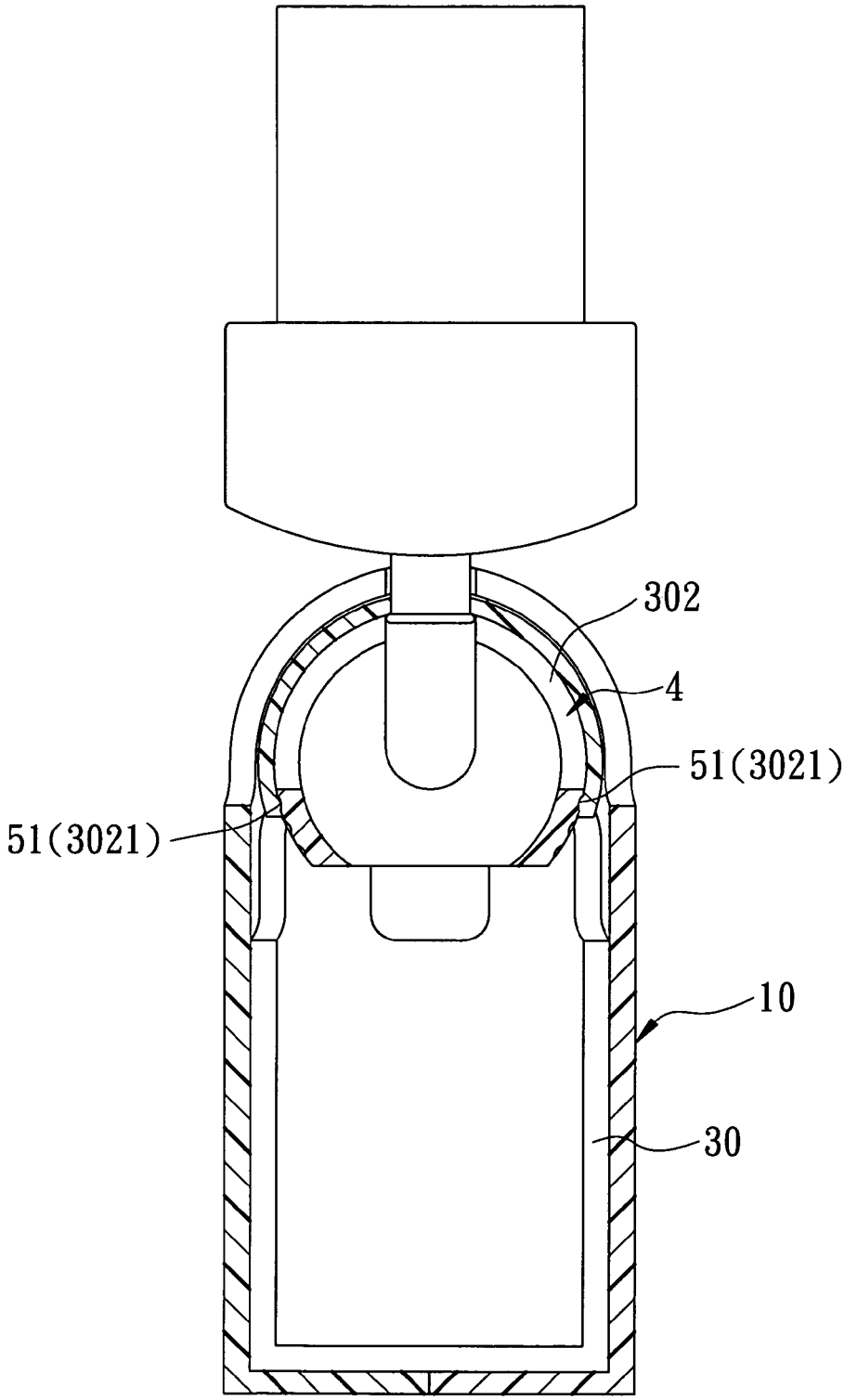
FIG. 9 is a fragmentary sectional view of the second preferred embodiment of an electronic device according to the present invention.

FIG. 9 illustrates the second preferred embodiment of an electronic device according to this invention. When compared with the previous embodiment, the dome-shaped portion 302 of the support body 30 and the arcuate sliding piece 5 manifest irregular surfaces 51, 3021 at points of contact therebetween for enhancing frictional contact therebetween.

Figure 10:
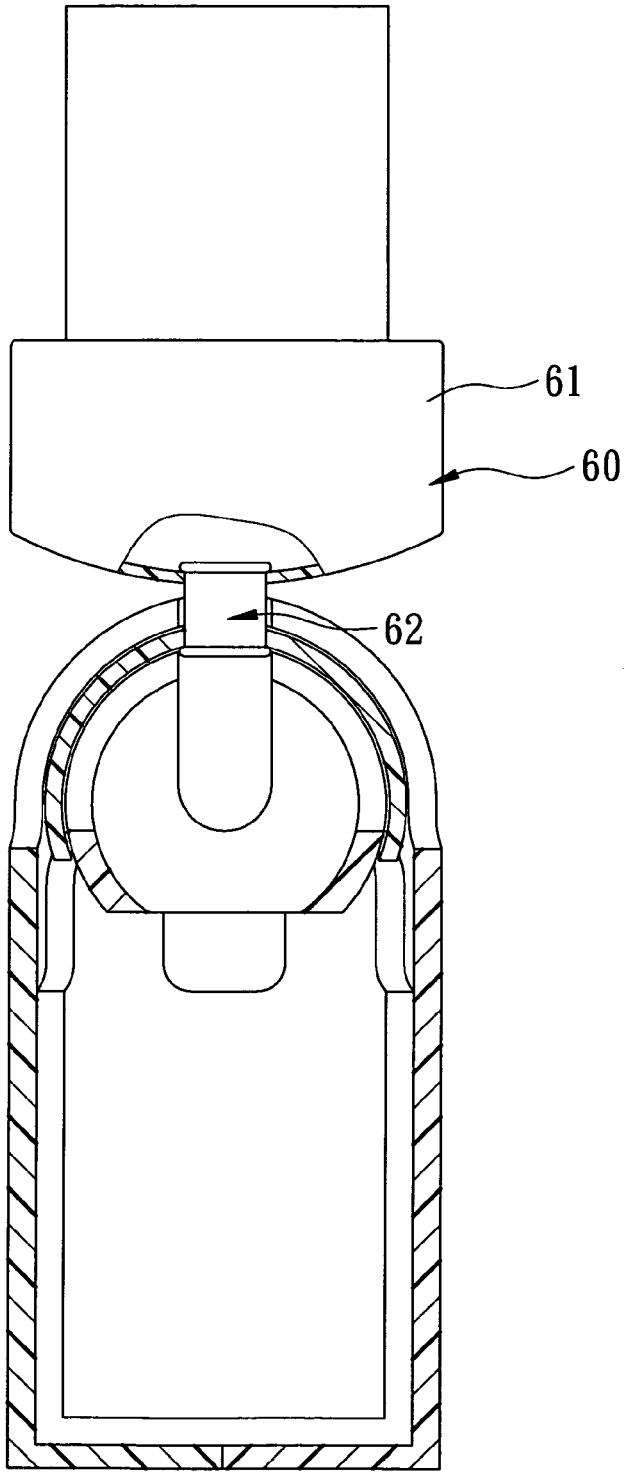
FIG. 10 is a fragmentary sectional view of the third preferred embodiment of an electronic device according to the present invention.

FIG. 10 illustrates the third preferred embodiment of an electronic device according to this invention. When compared with the previous embodiment, the connector-mounting portion 61 and the shaft portion 62 of the connector housing 60 are formed separately. The shaft portion 62 of the connector housing 60 extends into the connector-mounting portion 61, is flattened at the other end thereof, and is anchored to the connector housing 60.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electronic device, comprising:

a main housing having a dome-shaped portion that is formed with an arcuate slot unit;

a support body disposed in said main housing, and having a dome-shaped portion that is formed with an arcuate slot unit;

an arcuate sliding piece disposed movably between said dome-shaped portion of said main housing and said dome-shaped portion of said support body, and in sliding engagement with said dome-shaped portion of said support body;

a connector housing having a shaft portion that extends through said arcuate slot unit in said dome-shaped portion of said main housing and that is coupled to said arcuate sliding piece;

an electronic component mounted in said main housing; and an electrical connector mounted in said connector housing and coupled to said electronic component.

2. The electronic device as claimed in claim 1, wherein said support body further includes a cylindrical-shaped portion that has an open end, said dome-shaped portion of said support body being disposed on said open end of said cylindrical-shaped portion of said support body.

3. The electronic device as claimed in claim 1, wherein said shaft portion of said connector housing is coupled rotatably to said arcuate sliding piece.

4. The electronic device as claimed in claim 1, wherein each of said arcuate slot unit in said dome-shaped portion of said main housing and said arcuate slot unit in said dome-shaped portion of said support body includes crossed arcuate slots.

5. The electronic device as claimed in claim 1, wherein said main housing includes complementary first and second parts, each of which has a curved portion that is formed with a groove and a pair of recesses separated by said groove, said dome-shaped portion of said main housing being defined by said curved portions of said first and second parts of said main housing, said arcuate slot unit in said dome-shaped portion of said main housing being defined by said grooves and said recesses in said curved portions of said first and second parts of said main housing.

6. The electronic device as claimed in claim 1, wherein said dome-shaped portion of said support body includes complementary first and seconds parts, each of which is formed with a groove and a pair of recesses separated by said groove, said arcuate slot unit in said dome-shaped portion of said support body being defined by said grooves and said recesses in said first and second parts of said dome-shaped portion of said support body.

7. The electronic device as claimed in claim 2, wherein said cylindrical-shaped portion of said support body includes complementary first and second parts, each of which has an end portion formed with a pair of recesses and a groove disposed between said recesses, said open end of said cylindrical-shaped portion of said support body being defined by said end portions of said first and second parts of said cylindrical-shaped portion of said support body.

8. The electronic device as claimed in claim 1, wherein said electrical connector is a universal serial bus (USB) connector.

9. The electronic device as claimed in claim 1, wherein said arcuate sliding piece is made from ferrite.

10. The electronic device as claimed in claim 1, wherein said dome-shaped portion of said support body is made from ferrite.

11. The electronic device as claimed in claim 1, further comprising a cable that couples said electrical connector to said electronic component.

12. The electronic device as claimed in claim 11, wherein said cable includes two pairs of twisted wires, and a meshed metallic shield that surrounds said twisted wires.

13. The electronic device as claimed in claim 1, wherein said dome-shaped portion of said support body and said arcuate sliding piece manifest irregular surfaces for enhancing frictional contact therebetween.

* * * * *